US006383570B1

(12) United States Patent
Bose et al.

(10) Patent No.: US 6,383,570 B1
(45) Date of Patent: May 7, 2002

(54) THERMAL BARRIER COATING SYSTEM UTILIZING LOCALIZED BOND COAT AND ARTICLE HAVING THE SAME

(75) Inventors: Sudhangshu Bose, Manchester; Dinesh K. Gupta, South Windsor; Jeanine T. Marcin; Nicholas E. Ulion, both of Marlborough, all of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/745,781

(22) Filed: Dec. 21, 2000

Related U.S. Application Data

(62) Division of application No. 09/417,861, filed on Oct. 14, 1999, now Pat. No. 6,270,852, which is a division of application No. 09/096,501, filed on Jun. 12, 1998, now Pat. No. 6,284,390.

(51) Int. Cl.[7] ..... C23C 28/00

(52) U.S. Cl. ..... 427/405; 427/454; 427/456; 427/142; 427/258; 427/287; 29/889.71

(58) Field of Search ..... 427/454, 456, 427/142, 258, 287, 405; 29/889.1, 889.7, 889.71

(56) References Cited

U.S. PATENT DOCUMENTS

| | | | | |
|---|---|---|---|---|
| 4,005,989 A | | 1/1977 | Preston | 29/194 |
| 4,209,348 A | | 6/1980 | Duhl et al. | 148/3 |
| 4,321,311 A | | 3/1982 | Strangman | 428/623 |
| RE32,121 E | | 4/1986 | Gupta et al. | 428/656 |
| 4,585,481 A | | 4/1986 | Gupta et al. | 106/14.05 |
| 4,719,080 A | | 1/1988 | Duhl et al. | 420/443 |
| 4,895,201 A | | 1/1990 | DeCrescente et al. | 164/56.1 |
| 4,897,315 A | | 1/1990 | Gupta | 428/552 |
| 4,910,092 A | | 3/1990 | Olson et al. | 428/557 |
| 4,933,239 A | | 6/1990 | Olson et al. | 428/557 |
| 5,346,563 A | | 9/1994 | Allen et al. | 148/675 |
| 5,514,482 A | | 5/1996 | Strangman | 428/623 |
| 5,658,614 A | | 8/1997 | Basta et al. | 427/253 |
| 5,716,720 A | | 2/1998 | Murphy | 428/623 |
| 5,972,424 A | * | 10/1999 | Draghi et al. | 427/142 |

FOREIGN PATENT DOCUMENTS

| | | |
|---|---|---|
| EP | 0 969 116 A1 | 1/2000 |

* cited by examiner

*Primary Examiner*—Katherine A. Bareford
(74) *Attorney, Agent, or Firm*—F. Tyler Morrison

(57) ABSTRACT

A thermal barrier coating system for a superalloy substrate is disclosed. The superalloy is preferably of the type that is capable of forming an adherent alumina layer. A bond coat is applied to a local area of the substrate, so that a portion of the substrate remains exposed. The localized area is defined to be the area(s) at which a TBC typically fails first, e.g., the leading and trailing edges of an airfoil, or other area. An alumina layer is formed on the remaining portion of the substrate, and also on the bond coat. A ceramic layer is then applied on the alumina layer. Even if the ceramic material is removed, the localized bond coat remains, and reduces the rate at which the underlying substrate oxidizes. A coated article is also disclosed, as is a system that utilizes a conventional superalloy and aluminide coating with the localized bond coat.

6 Claims, 2 Drawing Sheets

THERMAL BARRIER COATING SYSTEM UTILIZING LOCALIZED BOND COAT AND ARTICLE HAVING THE SAME

CROSS REFERENCE TO RELATED APPLICATION

This is a division of application Ser. No 09/417,861, filed on Oct. 14, 1999, now U.S. Pat. No. 6,270,852 which is a divisional of Ser. No. 09/096,501 filed on Jun. 12, 1998 now U.S. Pat. No. 6,284,390.

This application is related to co-pending Application Ser. No. 60/089,152 (and related non-provisional Ser. No. 09/274,127 entitled "Surface Preparation Process For Deposition of Ceramic Coating" and filed on even date herewith.

FIELD OF THE INVENTION

The present invention relates generally to thermal barrier coatings, and relates more particularly to ceramic thermal barrier coating systems for superalloys.

BACKGROUND OF THE INVENTION

Thermal barrier coatings (TBCs) are widely used to reduce the operating temperatures of underlying substrates. For example, TBCs have been used for years in gas turbine engines, and more particularly in the turbine sections of such engines.

A typical TBC system utilizes a superalloy substrate, with a thin adherent alumina layer formed over the substrate, and a ceramic layer applied on the alumina layer. See, e.g., U.S. Pat. No. 4,321,311 to Strangman. Depending upon the particular superalloy, a separate bond coat, including but not limited to an MCrAlY or aluminide bond coat is provided on the substrate, and the adherent alumina layer is subsequently formed on the bond coat. M is selected from the group including nickel, cobalt, iron and combinations thereof. Alternatively, some superalloys can be oxidized to form an adherent alumina layer, and no separate bond coat is required. Exemplary alloys are described in commonly-owned U.S. Pat. Nos. 4,209,348 and 4,719,080 both to Duhl et al. A primary benefit of such superalloys is that there is no need to cover the substrate with a separate bond coat. The addition of a bond coat adds weight to a component without adding strength, which while undesirable generally, e.g., in gas turbine engines, is particularly undesirable on moving or rotating parts such as blades. On parts rotating at several thousands of revolutions per minute, the additional weight of the bond coat adds significantly to blade pull, e.g., corresponds to the centrifugal force due to the bond coat and increases with the square of the rotational speed. At elevated temperatures, the blade pull attributable to the bond coat also contributes to creep at the blade root, which affects the clearance between the blade tip and any surrounding structure and also affects engine efficiency and longevity. Moreover, a thick bond coat is subject to significant thermal fatigue due to the thermal stresses generated in the coat over the wide range of temperatures to which the component is exposed. Accordingly, use of superalloys capable of forming an adherent alumina layer are increasingly desired for use in rotating components such as turbine blades and compressor blade, as well as other moving components.

It is known that many ceramic materials, including stabilized or strengthened zirconia generally and by way of example zirconia having 7 percent by weight yttria (7YSZ) described in commonly-owned U.S. Pat. No. 4,321,311 to Strangman, are relatively transparent to oxygen.

Accordingly, underlying metal will oxidize (at generally manageable and predicable rates), and will oxidize at an increasing rate as the temperature increases. It is also known that the ceramic layer will eventually spall or otherwise fail, which in turn influences the service life of the component. Under normal operating conditions, service life subsequent to ceramic spallation is affected by the remaining bond coat or alloy oxidation life. As a general rule, the superalloys capable of forming an alumina layer without the use of a separate bond coat tend to be less oxidation resistant than conventional superalloys which utilize a separate bond coat, and we believe that higher oxidation resistance of conventional superalloys is due at least in part to a higher aluminum content, e.g., in the bond coat used with the conventional superalloys, as well as the presence of an intervening layer (the bond coat) between the substrate and its environment.

It is further known that portions of the ceramic material occasionally fail prematurely, for example due to localized spallation or foreign object damage, e.g., particulates formed during combustion, debris entrained in air ingested by the engine, or debris generated by broken upstage components. Underlying, exposed component areas are then subjected to significantly increased temperatures, and oxidize at correspondingly higher rates thereby reducing the life of the component. With respect to components that do not include a separate bond coat, the substrate material is exposed directly to the higher temperatures and increased oxygen, and oxidizes at even higher rates. The higher oxidation rate occurring on unprotected portions of substrate material in turn accelerates failure of the surrounding ceramic and exposure of additional substrate material, and the increased temperatures can melt or otherwise damage the substrate material.

It is an object of the present invention to provide a TBC system, preferably but not necessarily incorporating a superalloy that forms an adherent alumina layer, providing the benefit of reduced weight while still limiting oxidation in the event that the ceramic fails.

It is another object of the invention to provide such a system in which the service life of an associated component is not significantly shortened in the event of ceramic failure.

SUMMARY OF THE INVENTION

According to one aspect of the invention, a thermal barrier coating system for a superalloy substrate is disclosed.

The substrate comprises a superalloy of the type that is capable of forming an adherent alumina layer. See, e.g., U.S. Pat. Nos. 4,209,348 and 4,719,080 both to Duhl et al. By way of example the substrate may define a turbine blade of a gas turbine engine. A bond coat is applied to at least one local area of the substrate, so that a remaining portion of the substrate remains uncovered. The local area is selected to be the area(s) at which a TBC typically fails first, e.g., the leading and trailing edges of the blade airfoil, or other area. Preferably, an alumina layer is formed on the remaining portion of the substrate and also on the bond coat. Even if an overlying ceramic layer fails, the underlying bond coat remains, and limits the rate at which the underlying substrate material oxidizes.

According to another aspect of the present invention, a superalloy article is disclosed.

The article includes a superalloy substrate, such as a turbine blade of a gas turbine engine. The superalloy is of the type that is capable of forming an adherent alumina layer. A bond coat of the article is applied to at least one local area of the substrate, so that a portion of the substrate remains exposed. In the case of a turbine blade, the bond coat is preferably applied to the leading and trailing edges of the blade.

According to yet another aspect of the present invention, a method is disclosed for reducing the weight of a ceramic coated article of the type including a superalloy substrate, an adherent bond coat on the substrate, an alumina layer formed on the bond coat and a ceramic later on the alumina layer.

The method includes the steps of providing a superalloy substrate comprising a material capable of forming an adherent alumina layer; applying a bond coat to at least one local area of the substrate such that a remaining portion of the substrate remains uncovered; forming a thin adherent alumina layer on the remaining portion of the substrate and on the bond coat; and applying a ceramic layer on the alumina layer.

According to still another aspect of the present invention, a thermal barrier coating system for a superalloy article is provided. The coating system includes a superalloy substrate, and an aluminide coating and an MCrAlY bond coat applied to a localized area. The bond coat may be applied to a local area of the substrate with the aluminide being applied over the substrate and the bond coat, or the aluminide may be applied to the substrate with the bond coat being applied over a local area of the aluminide. A thin adherent alumina layer is formed over the aluminide and the bond coat, with a ceramic layer is on the alumina layer.

DETAILED DESCRIPTION OF THE PREFERRED EMBODIMENTS

Figure 1:
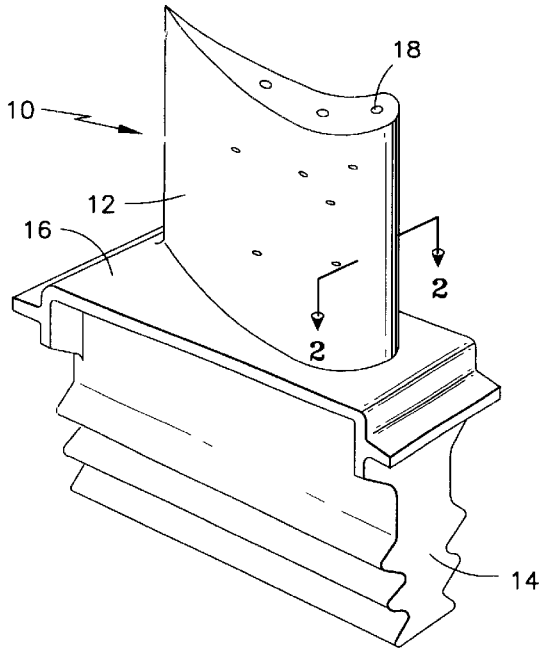
FIG. 1 is a perspective view of a turbine blade incorporating the present invention.

Turning now to FIG. 1, a turbine blade incorporating the present invention is illustrated generally by the reference numeral 10. The turbine blade includes an airfoil 12, a blade root 14 and a platform 16. Cooling holes 18, which may be positioned on one or more portions of a turbine blade and do not form part of the present invention, are typically provided for flowing cooling air over the airfoil during use, in a manner known in the art. While the present invention is illustrated in FIG. 1 as a turbine blade, the present invention may also be employed with vanes, supports and numerous components, the present invention is not intended to be limited to any particular component.

Figure 2:
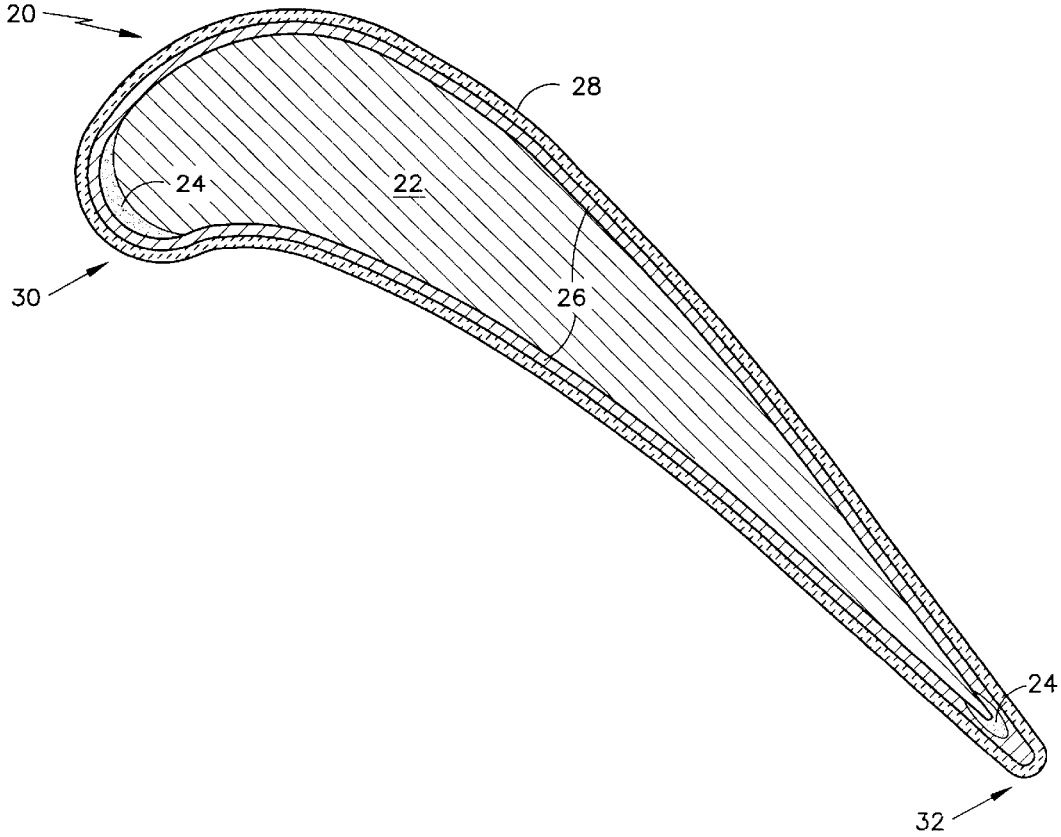
FIG. 2 is a schematic, cross sectional view of the blade of FIG. 1, illustrating a superalloy substrate, a localized bond coat, and alumina layer and a ceramic layer.

With reference to FIG. 2, the blade is protected by a thermal barrier coating system indicated generally by the reference numeral 20. The system protects the blade, which includes a substrate 22 (which may be hollow in part, not indicated in FIG. 2) made from a superalloy, such as a superalloy capable of forming an adherent alumina layer, i.e., an alumina layer to which the ceramic material will adhere. Exemplary alloys are disclosed in commonly-owned U.S. Pat. Nos. 4,209,348 and 4,719,080 both to Duhl et al., which are expressly incorporated by reference herein. Those patents disclose nickel-base superalloys having a general composition including about 8–12 w/o (percent by weight) chromium, about 4.5–5.5 w/o aluminum, 1–2 w/o titanium, 3–5 w/o tungsten, 10–14 w/o tantalum, 3–7 w/o cobalt, balance essentially nickel. Those skilled in the art will recognize that other alloys may be incorporated into the present invention with equal effect, including but not limited to superalloy articles having reduced sulfur content such as those described in commonly-owned U.S. Pat. Nos. 4,895,201 to DeCresente et al. and U.S. Pat. No. 5,346,563 to Allen et al., which are also expressly incorporated by reference herein. The present invention is not intended to be limited to alloys disclosed in the above patents. The thermal barrier system 20 includes a bond coat 24, a thin alumina layer 26 formed on the bond coat and the substrate, and a ceramic material 28 on the alumina layer.

Superalloys of the type capable of forming an adherent alumina layer without using a separate bond coat realize a weight savings over conventional superalloys, since no separate bond coat need be added. As noted above, moving parts such as rotating turbine blades benefit greatly from the weight savings associated with a lack of a separate bond coat. However, components fabricated from these alloys are susceptible to reduced life in the event that a portion of the overlying ceramic material fails, e.g., is removed due to impact damage, with subsequent substrate oxidation.

We have determined that the incorporation of a separate bond coat, applied to selected areas of the component, can extend the service life of a component after a portion of the ceramic material fails. With reference to the blade of FIGS. 1 and 2, it has been determined that the ceramic layer 28 tends to fail first in localized areas, particularly at the leading and trailing edges of the airfoil 12. Such failure is typically caused by factors such as impact by particulates formed during combustion, or debris entrained in the air ingested through an engine inlet. Failure of the ceramic can also occur in other manners, e.g., spallation due to thermal stresses. As noted above, superalloy material exposed directly to elevated temperatures oxidizes at a much higher rate than does superalloy material covered by the ceramic, and in turn accelerates the failure of surrounding ceramic and associated substrate oxidation, all of which subjects the substrate material to higher temperatures which can result in shorter services lives or potential component failure.

In order to retard substrate oxidation in the event of ceramic failure, the present invention incorporates the bond coat 24 onto the areas in which the ceramic is likely to fail first. In the case of the illustrated turbine blade, those areas typically include at least the leading 30 and trailing edges 32 of the airfoil 12. As used herein, the terms leading edge and trailing edge mean the area within a specified distance, e.g., 0.5 inch, from the exact leading edge and the exact trailing edge. We believe that it is unnecessary to apply the bond coat to other areas, but do not rule out applying the bond coat to other areas. The particular areas to which the bond coat is applied will, of course, depend upon the particular component involved, its shape and operating environment, as well as other factors such as susceptibility to erosion, stresses in the ceramic due to curvature of the part—leading and trailing edges, and airfoil thickness—very thin cross sections tend to oxidize rapidly and affects the geometry of the airfoil. The remaining portions of the substrate material are not covered by the bond coat material. Typically, the bond coat is applied to less than about 50%, and preferably less than about 20–25%, of the surface area defined by the substrate.

The bond coat is preferably but not necessarily an MCrAlY bond coat, such as the bond coat disclosed in commonly-owned U.S. Pat. No. 4,585,481 and Reissue No. 32,121, both to Gupta et al., or an aluminide bond coat, as is disclosed for example in U.S. Pat. Nos. 5,514,482 to Strangman, 5,658,614 to Basta et al. and 5,716,720 to Murphy. The M in MCrAlY is selected from the group including nickel, cobalt and iron. The bond coat is typically, although not necessarily, applied by plasma spraying. See, e.g., U.S. Pat. Nos. 4,321,311 and 4,585,481 and Reissue No. 32,121. Application of the bond coat by other applications, including but not limited to, electron-beam physical vapor deposition, chemical vapor deposition, cathodic arc and electroplating are also possible. It may be desirable to mask those portions of the substrate to which the bond coat will not be applied. While the bond coat thickness may vary depending upon the particular component, application and portion of the component being coated, the illustrated bond coat preferably has a thickness of less than about 5 mils, more preferably less than about 3 mils, and if applied as an overlay is preferably tapered at its edges to be flush with the substrate surface.

The alumina layer 26 is formed in a conventional manner, e.g., by heating the bond coat in a controlled, oxidizing environment. The preferred manner of preparing the surface and of forming the alumina is described in co-pending U.S. Pat. Application Ser. No. 60/089,152 (and related non-provisional Ser. No. 09/274,127 entitled "Surface Preparation Process for Deposition of Ceramic Coating", filed on even date herewith and expressly incorporated by reference herein. Those skilled in the art will recognize that the alumina layer may be formed before, during or after application of the ceramic.

The ceramic material is applied to form the ceramic layer 28. While the invention is not limited to any particular ceramic material or manner of application, a typical ceramic material employed on turbine blades by the assignee of the present invention is 7YSZ (yttria stabilized or "strengthened" zirconia, 7% yttria by weight), preferably applied by electron beam physical vapor deposition. See, e.g., commonly-owned U.S. Pat. No. 4,321,311 to Strangman. The particular material and application method will depend upon the component and its intended operating environment.

The present invention provides significant advantages over known articles and systems. For oxidation prevention, a separate bond coat is applied to the substrate, but only to selected areas of the substrate, thus realizing a substantial weight savings over conventional systems which include a separate bond coat covering the entire substrate. Where the ceramic material fails, the increased oxidation that would otherwise occur is minimized by the presence of the bond coat, which serves as an oxygen barrier for the underlying portion of the substrate. The present invention enables the use of those superalloys which do not require separate bond coats, with the assurance that the components will have reasonable service lives in the event that a portion of the ceramic material fails, e.g., due to foreign object damage.

We have tested the present invention on blades in an experimental engine. Some of the blades included the bond coat applied to the leading and/or trailing edges of the airfoil portions, and others did not. The blades were tested over 935 "endurance cycles", during which the ceramic material on some blades was intentionally removed prior to testing, e.g., utilizing high pressure jets of water. An endurance cycle corresponds to the range of typical engine operation, including engine idle, take-off (at or near maximum power), climb, cruise, thrust reverse and idle. The blade areas including the localized bond coat on the leading and/or trailing edges did not exhibit significant oxidation in the underlying substrate material, while the blade areas without the localized bond coat exhibited signs of significant oxidation. The tests verify that a localized bond coat significantly reduces oxidation of the underlying superalloy substrate material even after failure of the overlying ceramic material.

Figure 3:
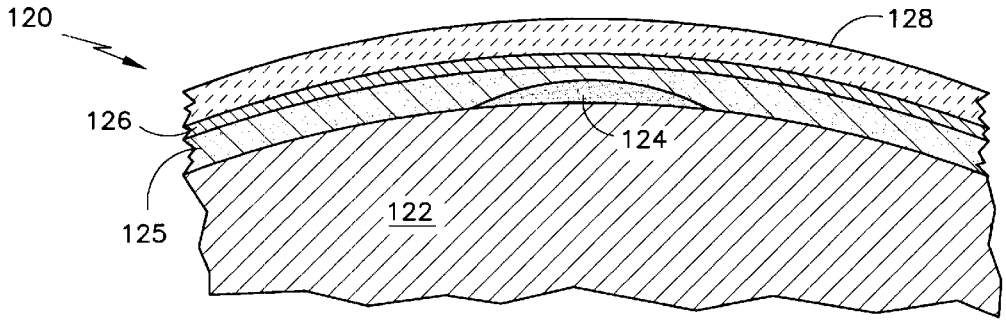
FIG. 3 is a fragmentary, sectional view of a second embodiment of the invention, including a superalloy substrate, a localized MCrAlY bond coat, an aluminide bond coat, and a ceramic layer.

With reference to FIG. 3, the present invention may also utilize conventional superalloys, e.g., of the type to which a separate bond coat is applied for purposes of subsequently forming the adherent alumina layer, and which include the ceramic thermal barrier coating on the alumina layer. Such bond coats include but are not limited to MCrAlY bond coats and aluminide bond coats applied by various methods. Examples of aluminide bond coats are disclosed, e.g., in commonly owned U.S. Pat. No. 4,005,989 to Preston, and U.S. Pat. No. 5,514,482 to Strangman, and may also include additions of Hf, Y and other oxygen active elements. Such articles are also subjected to increased temperatures and correspondingly increased oxidation in the event that an overlying ceramic TBC fails. Accordingly, another thermal barrier coating system 120 of the present invention incorporates a superalloy substrate 122 of the type that does not inherently form an adherent alumina layer. Exemplary alloys include but are not limited to nickel, cobalt and iron base superalloys, such as IN 718, Waspalloy, Thermospan®, and numerous other alloys. An MCrAlY bond coat 124, for example the type described in U.S. Pat. No. 4,585,481 or Reissue No. 32,121 both to Gupta et al., is applied to one or more local areas of the substrate. An aluminide bond coat 125 is then applied over the MCrAlY bond coat and exposed portions of the substrate, and is subsequently processed, e.g., heated, to form an alumina layer 126 and a ceramic 128 is also applied. The aluminide typically diffuses some distance into the material to which it is applied, e.g., up to a few mils, and diffuses at least partially into the MCrAlY bond coat depending upon the bond coat thickness. It is believed that the particular manner of applying the aluminide is not critical to the invention, e.g., application may be performed by one of a number of known manners such as chemical vapor deposition (CVD), plating, slurry, and in-pack or out of pack diffusion. The ceramic layer 128, e.g., 7YSZ is also applied, as described above with reference to FIGS. 1 and 2, for example by EB-PVD.

Figure 4:
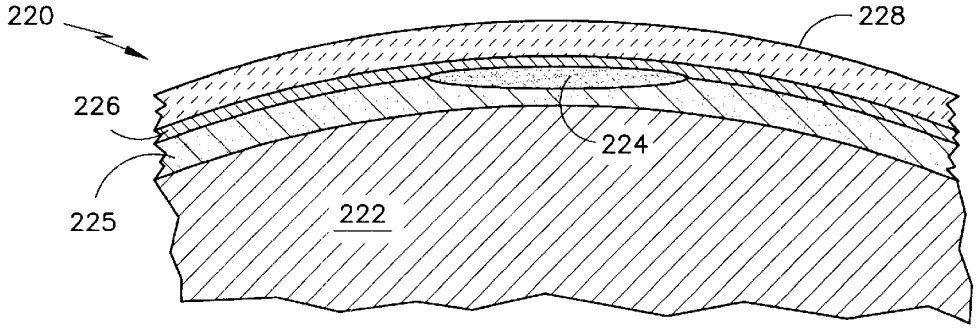
FIG. 4 is a fragmentary, sectional view of a third embodiment of the invention, including a superalloy substrate, an aluminide bond coat, a localized MCrAlY bond coat, and a ceramic layer.

FIG. 4 illustrates still another thermal barrier coating system 220 in accordance with the present invention, and also incorporates a superalloy substrate 222 of the type that does not inherently form an adherent alumina layer. Prior to application of an MCrAlY bond coat 224, an aluminide bond coat 225 is applied to the surface of the substrate. The MCrAlY bond coat is thereafter applied over at least one local portion of the aluminide. The exposed aluminide and MCrAlY bond coat is processed to form an alumina layer, and as noted above may occur before, during or after application of the ceramic layer 228 for example by EB-PVD.

While the present invention has been described above in some detail, numerous variations and substitutions may be made without departing from the spirit of the invention or the scope of the following claims. Accordingly, it is to be understood that the invention has been described by way of illustration and not by limitation.

What is claimed is:

1. A method of applying a thermal barrier coating system to a substrate, comprising the steps of:

providing a superalloy substrate;

applying an MCrAlY bond coat to a localized area of the substrate such that a portion of the substrate remains exposed, wherein M is selected from the group consisting of nickel, cobalt, iron and combinations thereof;

applying an aluminide coating to the exposed portion of the substrate and to the bond coat; forming an adherent alumina layer on the alumindie layer; and applying a ceramic layer on the alumina layer.

2. The method according to claim 1, wherein the bond coat is applied only to a localized area area susceptible to premature failure of the ceramic layer.

3. The method according to claim 1, wherein the substrate provided comprises an airfoil having a leading edge and a trailing edge, and the bond coat is applied to at least one of the leading edge and the trailing edge.

4. The method according to claim 1, wherein the ceramic layer is applied to have a columnar microstructure.

5. The method according to claim 1, wherein the localized areas of the article are prone to damage by particulate matter or debris.

6. The method according to claim 1, wherein the bond coat is applied to less than about 50% of the substrate area.

* * * * *